US007469124B1

(12) United States Patent
Chethik

(10) Patent No.: US 7,469,124 B1
(45) Date of Patent: Dec. 23, 2008

(54) RATE ADAPTIVE SATELLITE COMMUNICATIONS

(75) Inventor: Frank Chethik, Palo Alto, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 1173 days.

(21) Appl. No.: 10/412,553

(22) Filed: Apr. 11, 2003

(51) Int. Cl.
*H04H 20/47* (2008.01)

(52) U.S. Cl. ..... 455/3.02; 370/329; 375/141

(58) Field of Classification Search ..... 455/3.02, 455/3.03

See application file for complete search history.

(56) References Cited

U.S. PATENT DOCUMENTS

| | | | | |
|---|---|---|---|---|
| 6,215,793 | B1 * | 4/2001 | Gultekin et al. | 370/465 |
| 6,320,850 | B1 * | 11/2001 | Perahia et al. | 370/316 |
| 6,415,329 | B1 * | 7/2002 | Gelman et al. | 709/245 |
| 6,445,702 | B1 * | 9/2002 | Wright | 370/389 |
| 6,763,058 | B1 * | 7/2004 | Morris | 375/141 |
| 7,007,220 | B2 * | 2/2006 | Zhang et al. | 714/752 |
| 7,079,550 | B2 * | 7/2006 | Padovani et al. | 370/468 |
| 7,133,395 | B2 * | 11/2006 | Simonsen et al. | 370/345 |
| 7,174,179 | B2 * | 2/2007 | Krebs et al. | 455/504 |
| 2001/0017849 | A1 * | 8/2001 | Campanella et al. | 370/326 |
| 2002/0146030 | A1 * | 10/2002 | Simonsen et al. | 370/442 |
| 2003/0054816 | A1 * | 3/2003 | Krebs et al. | 455/428 |
| 2003/0167432 | A1 * | 9/2003 | Zhang et al. | 714/747 |
| 2004/0073916 | A1 * | 4/2004 | Petrovic et al. | 725/18 |
| 2004/0131028 | A1 * | 7/2004 | Schiff et al. | 370/329 |
| 2006/0156185 | A1 * | 7/2006 | Zhang et al. | 714/758 |
| 2007/0021060 | A1 * | 1/2007 | Karabinis et al. | 455/12.1 |
| 2007/0121758 | A1 * | 5/2007 | Sindhushayana et al. | 375/297 |

* cited by examiner

*Primary Examiner*—Matthew D. Anderson
*Assistant Examiner*—Hai V Nguyen
(74) *Attorney, Agent, or Firm*—McDermott Will & Emery LLP

(57) ABSTRACT

A system and method for transmitting data from a satellite to a terrestrial receiving station are provided. The system comprises a satellite including a rate adaptive data receiver. The system is configured to establish a data transmission for the satellite to the terrestrial receiving station; the data transmission having an initial transmission rate. The system further monitors one or more downlink parameters of the data transmission, and when the one or more downlink parameters meets a criteria, both the rate adaptive data transmitter and the rate adaptive data receiver simultaneously adjust the data transmission to a new data transmission rate, and transmit the data at the new data transmission rate.

38 Claims, 6 Drawing Sheets

RATE ADAPTIVE SATELLITE COMMUNICATIONS

BACKGROUND OF THE INVENTION

The present invention relates generally to satellite communications systems and methods, and more particularly to systems and methods for adaptively varying the transmission rate of data from a satellite to a terrestrial receiver.

Low earth orbiting ("LEO") satellites, such as those launched by NASA and other entities, are used for a variety of purposes. For example, such LEO satellites can be used to analyze certain properties or qualities of the earth and objects on the earth, such as magnetic properties of the earth, cloud cover, crop quality, infrared energy from earth objects, and even ground images. The satellites typically include sensors and/or cameras to collect data as they orbit the earth, and they download the data to a terrestrial network gateway as they pass over. The data then can be provided to scientists or other parties for analysis and study.

As one skilled in the art will appreciate, a typical orbit period for a LEO satellite is about 90 minutes or so. Also, because the satellites do not retrace the same path over the earth's surface on each orbit, an LEO may not be visible to the ground station receiver for several orbits. Because of this, the satellites can collect huge amounts of data before it can be downloaded to the terrestrial network gateway.

As the satellites collect data, they store it on disks or other media. Then, as the satellites pass into communication "sight" of the terrestrial network gateway, they download as much of the data as possible during the brief visibility interval. As one skilled in the art will appreciate, this interval can be as low as about 3-4 minutes and as high as about 20 minutes. It is important to download as much data as possible during the visibility interval.

The problem with the prior art satellite communication systems is that they are designed to download data for worst case scenario conditions; i.e., worst visibility angle, worst rain/weather conditions, etc. The problem, however, is that the conditions are very rarely worst case, so the prior art communication systems are very constraining. Basically, the prior art systems obtain worst case performance.

Thus, what is needed is a system and method to improve the data download capacity from satellites to the terrestrial networks, or alternatively to achieve the desired download capacity with minimum satellite resources such as transmitter power and antenna size.

BRIEF SUMMARY OF THE INVENTION

A system and method for transmitting data from a satellite to a terrestrial receiving station. In accordance with one embodiment of the invention, the system comprises a satellite including a rate adaptive data transmitter and a terrestrial receiving station including a rate adaptive data receiver. The system is configured to establish a data transmission from the satellite to the terrestrial receiving station; the data transmission having an initial transmission rate. The system further monitors one or more downlink parameters of the data transmission, and when the one or more downlink parameters meets a criteria, both the rate adaptive data transmitter and the rate adaptive data receiver adjust the data transmission to a new data transmission rate, and transmit the data at the new data transmission rate.

In one embodiment, the system is further configured to estimate a link quality between the satellite and the terrestrial receiving station and set the initial transmission rate based on that estimate. In accordance with this aspect of the present invention, the system may estimate the link quality by estimating a signal to noise ratio for the communication between the satellite and the terrestrial receiving station, and the system may set the initial transmission rate based on that estimate.

In another embodiment of the invention, the system further may be configured to determine a threshold signal quality for the data transmission, monitor a signal quality of the communication between the satellite and the terrestrial receiving station, and upon reaching the minimum threshold signal quality, establish the data transmission at the initial transmission rate. In one embodiment, the signal quality is a signal to noise ratio.

In another embodiment, the one or more downlink parameters may comprise signal to noise ratio, data error rate, and location of the satellite in relation to the terrestrial receiving station. In one embodiment, the criteria to which the one or more downlink parameters are compared determine positive and negative signal quality criteria. Thus, when the one or more downlink parameters meet positive signal quality criteria, the data transmission rate is adjusted higher, and when the one or more downlink parameters meet negative signal quality criteria, the data transmission rate is adjusted lower.

In one embodiment, the system may be configured to adjust the data transmission to a new data transmission rate that is determined from the one or more downlink parameters. In another embodiment, the system may be configured to adjust the data transmission to a new data transmission rate that is an integral multiple of the initial data transmission rate. In yet another embodiment, the system may be configured to adjust the data transmission to a new data transmission rate that is a factor of two of the initial data transmission rate.

In one embodiment, the satellite further comprises a data receiver, and the terrestrial receiving station comprises a data transmitter, and the terrestrial receiving station is configured to monitor the one or more downlink parameters and initiate the adjustment of the data transmission rate. In accordance with this aspect of the invention, the system adjusts the data transmission rate by the data transmitter of the terrestrial receiving station sending a command to the data receiver of the satellite; the command instructing the rate adaptive data transmitter of the satellite to change the data transmission rate. In one embodiment, the rate adaptive data transmitter at the satellite may be configured to format the data prior to transmitting it. Thus, upon receiving the command from the terrestrial receiving station, the rate adaptive data transmitter inserts control data defining a timing epoch upon which the new data transmission is to be implemented into the data stream. Upon reaching the timing epoch, the rate adaptive data transmitter sends, and the rate adaptive data receiver receives data at the new data transmission rate.

In yet another embodiment, the satellite is configured to monitor an uplink received signal parameters and initiate the new data transmission rate. In accordance with this aspect of the present invention, the rate adaptive data transmitter is configured to format the data stream prior to transmitting it. Thus, when the satellite determines that it is appropriate to change the data transmission rate, the rate adaptive data transmitter inserts control data defining a timing epoch upon which the new data transmission is to be implemented into the data stream. Upon reaching the timing epoch, the rate adaptive data transmitter sends, and the rate adaptive data receiver receives data at the new data transmission rate.

In one embodiment, the data is transmitted in symbols, and the system adjusts that data transmission rate by changing the symbol complexity of the data transmission. For example, the symbols may comprise binary phase shift keying (BPSK) symbols, quaternary phase shirt keying (QPSK) symbols, 8PSK symbols, or any of quadrature amplitude modulation (QAM) symbols, such as 16QAM, 32QAM, 64QAM, 128QAM, 256QAM, and the like. As one skilled in the art will appreciate, the symbol complexity increases from BPSK to QPSK to 8PSK to the QAM symbols, with 256QAM likely being the most complex.

The present invention further comprises methods for transmitting data from a satellite to a terrestrial receiving station with adaptive transmission rates, as well as the satellite and terrestrial receiving stations and the technology incorporated therein for performing the adaptive rate transmissions.

A more complete understanding of the present invention may be derived by referring to the detailed description of preferred embodiments and claims when considered in connection with the figures.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

FIG. 4(*b*) is a block diagram of the satellite communication system of FIG. 4(*a*);

DETAILED DESCRIPTION OF THE INVENTION

The present invention relates generally to satellite communications systems and methods, and more particularly to systems and methods for adaptively varying the transmission rate of data from a satellite to a terrestrial receiver or receiving station.

As one skilled in the art will appreciate, there are a number of factors that affect the transmission of data from low earth orbit (LEO) and medium earth orbit (MEO) satellites to terrestrial receiving stations, such as weather and the location of the satellite in relation to the receiving station. For example, when a satellite first comes into view of the terrestrial receiving station, it still is a relatively long distance from the station. As a result, the path loss through free space and long atmospheric path creates signal losses, which limit the rate of data that can be transmitted from the satellite to the terrestrial receiving station. As time passes, the satellite passes more overhead of the terrestrial receiving station, shortening the free space distance between the satellite and the station and shortening the path through the atmosphere, and thus increasing the data rate transmission capacity. Late in the pass the path length increases, thus decreasing the data transmission capacity again.

Figure 1:
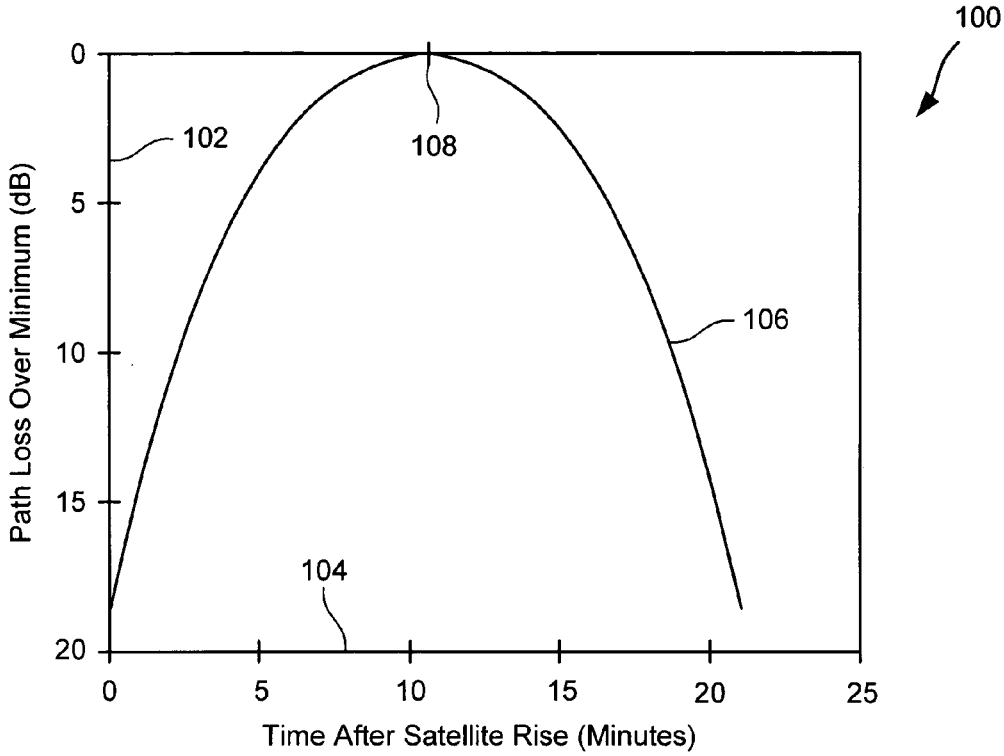
FIG. 1 is a graph showing range and atmospheric path loss over the minimum path loss for low earth orbit satellite communication path over time.

This phenomenon is illustrated in graph 100 of FIG. 1. Graph 100 shows a plot 106 of the path loss 102 of a satellite transmission over time 104. As illustrated, the path loss 102 for plot 106 is relatively high as a satellite first comes into "sight" of a terrestrial receiving station. The path losses decrease as the satellite approaches the zenith or closest position 108 to the receiving station, and then the path losses again increases as the satellite moves further away.

As a result, the data transmission capacity for satellite downloads changes over time based on the location of the satellite in relation to the terrestrial receiving station. Unfortunately, because there has not been a way to adaptively change the data transmission rate from the satellite to the terrestrial receiving station, the data traditionally is transmitted at a fixed rate, the worst-case supportable data rate. As one skilled in the art will appreciate, this is a very inefficient way to transmit data, because the fixed rate transmissions of the prior art systems must account for worst case or near-worst case conditions.

Figure 2:
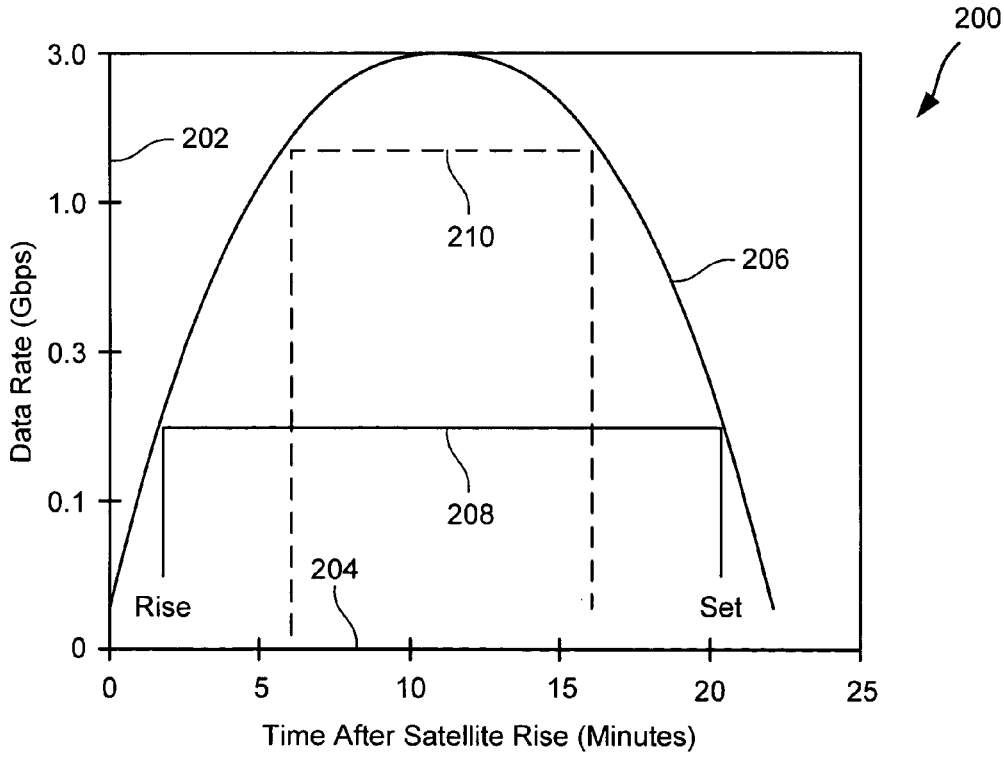
FIG. 2 (Prior Art)
FIG. 2 is a graph showing fixed data rate transmissions for prior art low earth orbit satellite communications over time.

Graph 200 in FIG. 2 illustrates fixed rate transmissions of prior art systems. Graph 200 shows a plot 206 for data transmission rates 202 over time 204 for LEO and/or MEO satellites. As with the path loss graph 200, the data transmission rates increases over time until the satellite reaches the zenith, and then decreases again. With constant data rate transmission systems, such as those known in the prior art, the systems typically pick the data rate at which they want to transmit. If the systems choose to transmit for a longer period of time, the data transmission rate must be lower because the transmission begins and ends when the transmission capacity is low. This type of data transmission rate is illustrated in FIG. 2 as data rate 208. Similarly, if the systems choose to transmit at a higher data transmission rate, the systems must transmit for a shorter period of time because the window for transmitting at the higher rate is shorter. This type of data transmission rate is illustrated in FIG. 2 as data rate 210.

Figure 3:
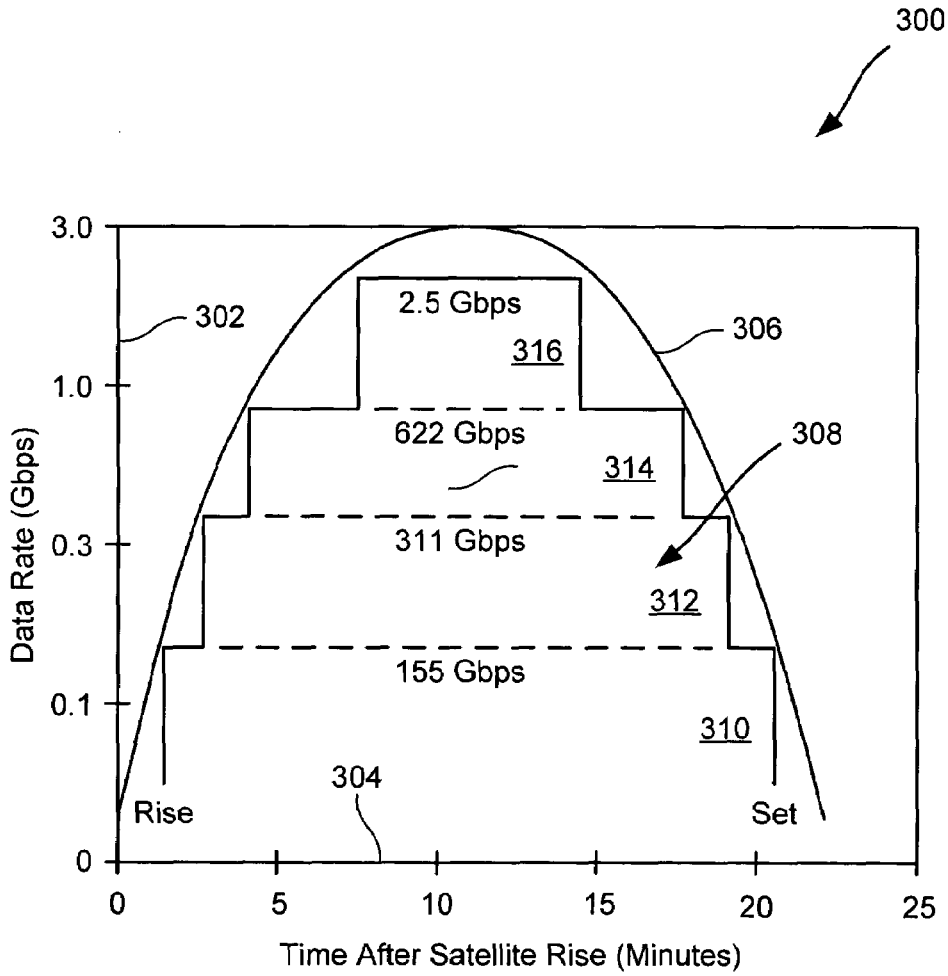
FIG. 3 is a graph showing one embodiment of adaptive data rate transmissions for satellite communications over time in accordance with the present invention.

Referring now to FIG. 3, graph 300 shows a plot 306, which is similar to plot 206 of FIG. 2, illustrating the data rate 302 over time 304 for an LEO or MEO satellite. Graph 300 shows an adaptive data rate curve 308, which illustrates how data transmission rates 310, 312, 314 and 316 can be changed over the entire path to improve the efficiency of the data transmission in accordance with the present invention. That is, as the data transmission capacity increases, the data transmission rate is increased accordingly. Similarly, as the data transmission capacity decreases after the zenith, the data transmission rate is decreased. Thus, with a traditional prior art system, the downlink data rate may be fixed at, for example, 311 Mbps (312), whereas in the adaptive or variable rate system of the present invention, the highest supportable rate may increase to, for example, 2.5 Gbps (316). With systems and methods of the present invention, the total download during the pass interval may be increased by a factor of 4 to 8, or so. More detail as to how the adaptive data transmission rate can be implemented is set forth below.

Figure 4A:
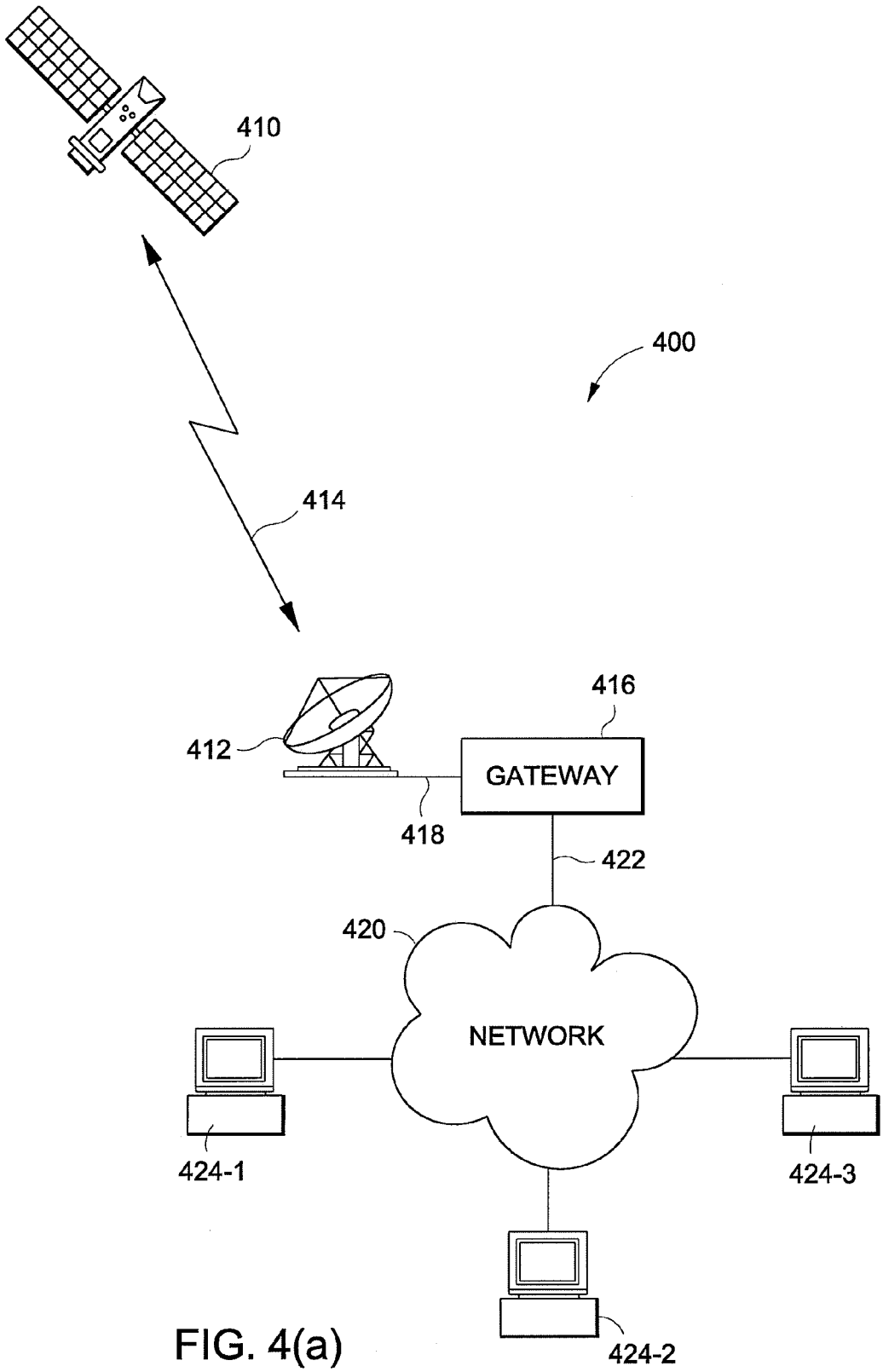
FIG. 4(*a*) is a schematic diagram of one embodiment of a satellite communication system in accordance with the present invention.
Figure 4B:
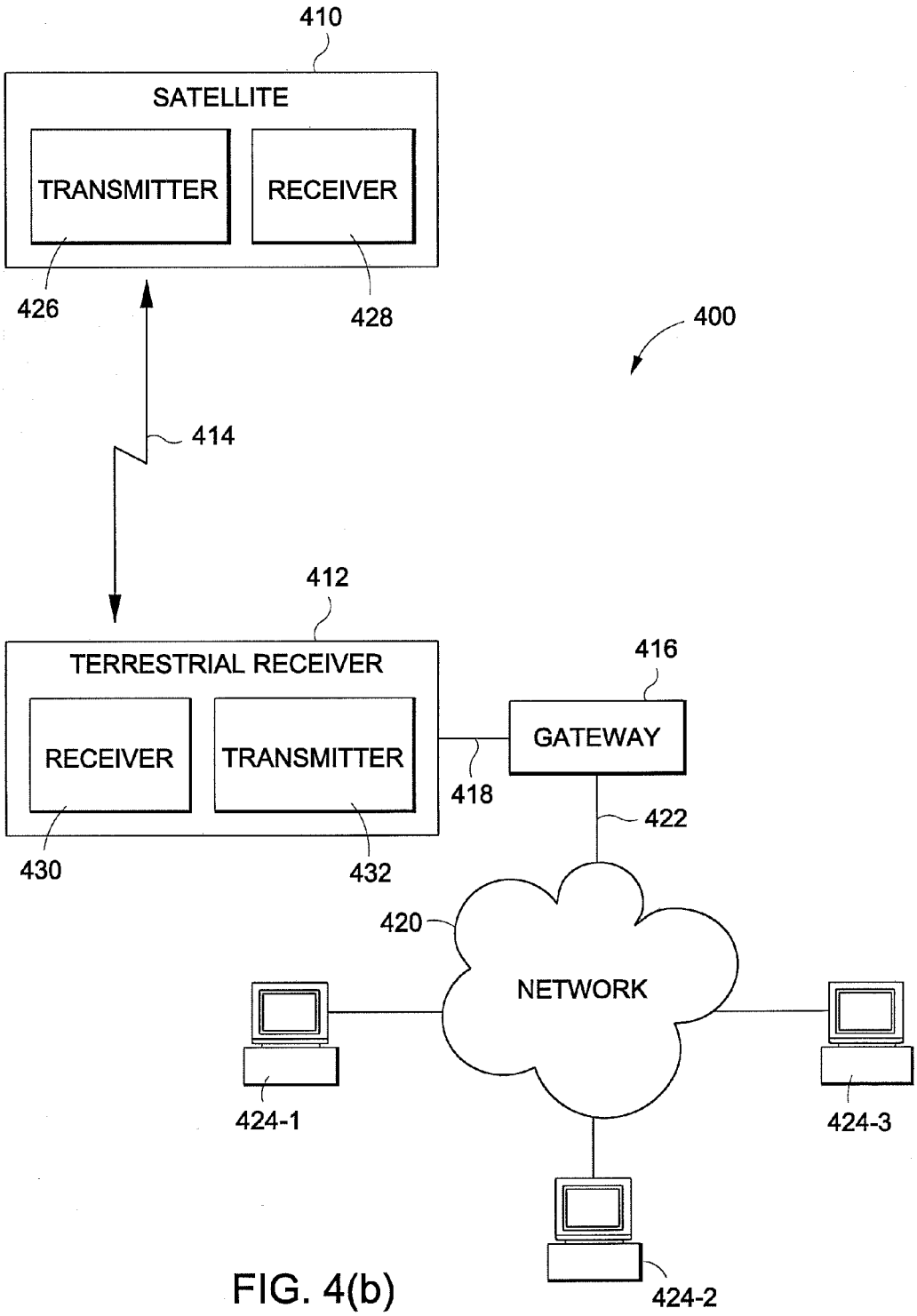

Referring now to FIG. 4(*a*) a schematic diagram of a satellite communications system 400 in accordance with one embodiment of the present invention is shown. In the illustrated embodiment, satellite communications system 400 comprises a satellite 410, a terrestrial receiver or antenna 412, a terrestrial network gateway 416, a network 420, and workstations or user devices 424. In accordance with one embodiment, satellite 410 can comprise any suitable data collection or communications satellite, including LEO and MEO satellites, and satellite 410 is configured to download or transmit data to terrestrial receiver 412 via a wireless communication connection 414, typically in the range of about 10 GHz to about 30 GHz frequencies.

In the illustrated embodiment, terrestrial receiver 412 is connected to terrestrial network gateway 416, for example via electrical connection 418. In turn, gateway 416 is connected to network 420 via electrical connection 422. As one skilled in the art will appreciate, network 420 can be any suitable network, such as a local area network, a wide area network, a virtual private network, the Internet, or any other suitable network configuration. Similarly, electrical connections 418 and 422 may comprise any suitable electrical connection, such as a direct wired connection, a network connection, or a wireless connection. As one skilled in the art will appreciate, system 400 is configured such that data is downloaded from satellite 410 to receiver 412 and then to gateway 416. Gateway 416 is configured to provide the data to network 420, so that scientist and other uses can access the data, for example using workstations or user devices 424 connected to network 420.

As illustrated in the block diagram of FIG. 4(*b*), satellite 410 may be configured with both a transmitter 426 and a receiver 428. In one embodiment, transmitter 426 is a rate adaptive transmitter that can be configured to change data transmission rates during a data download, as discussed in more detail below. One such type of rate adaptive transmitter that can be used in the present invention is described in U.S. Pat. No. 5,612,651, entitle "Modulating Array QAM Transmitter," which issued on Mar. 18, 1997 to Frank Chethik, and which is incorporated by reference herein for all purposes. Receiver 428 in satellite 410 may comprise any suitable communications receiver.

Similarly, terrestrial receiver 412 may be configured with both a receiver 430 and a transmitter 432. In one embodiment, receiver 430 is a rate adaptive receiver that can be configured to change data transmission receiving rates during a data download. Transmitter 432 in terrestrial receiver 412 may comprise any suitable communications transmitter.

Figure 5:
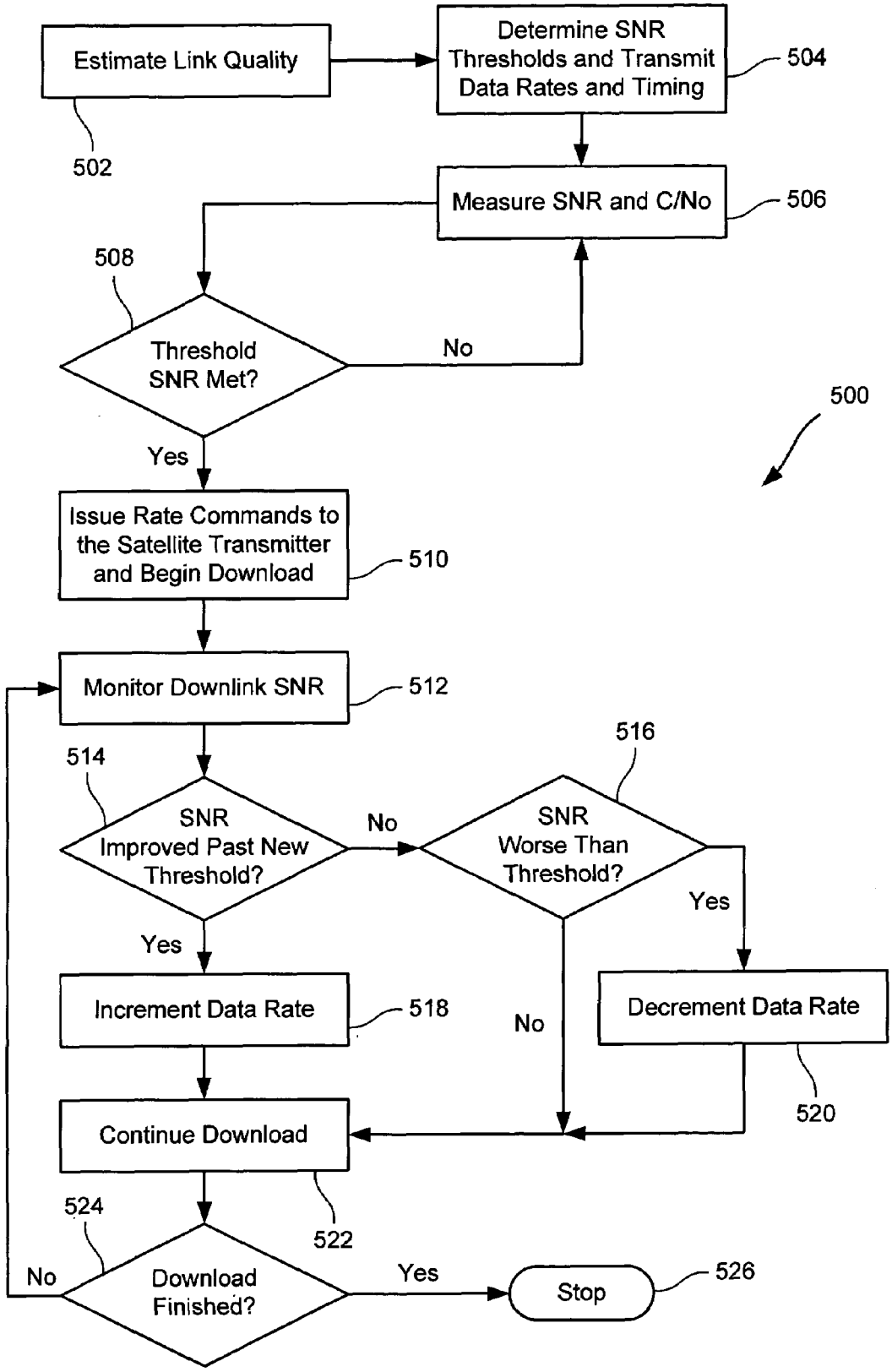
FIG. 5 is a flow chart illustrating one embodiment of a method for implementing an adaptive data rate transmission for satellite communications in accordance with the present invention.

Referring now to FIG. 5, one embodiment of a method 500 for providing an adaptive rate data transmission from a satellite 410 to a terrestrial receiver 412 and/or terrestrial gateway 416 will be described. For purposes of this discussion, the combination of terrestrial receiver 412 and gateway 416 will be referred to as a terrestrial receiving station. One skilled in the art, however, will appreciate that a terrestrial receiving station may comprise any combination of antennas, receivers, transmitters, and data processing equipment used to receive and process data from a satellite transmission. The configuration and operation of such equipment is known in the art, and thus, will not be described in detail herein.

In the illustrated embodiment, as a satellite becomes visible to terrestrial receiving station, the system begins estimating the link quality between the satellite and receiving station (block 502). In one embodiment the terrestrial receiving station performs the link quality analysis, while in an alternative embodiment, the satellite may be configured to perform the analysis, for example, by estimating signal quality from a beacon transmitted from the receiving station to the satellite. As one skilled in the art will appreciate, there are many methods to estimate the link quality. In one embodiment, the system estimates the signal to noise rations (SNR) of the transmitted signal, however, other estimation techniques may be used. As one skilled in the art will appreciate, the SNR will be a function of a number of variables, such as the position of the satellite to the receiving station, atmospheric conditions/interferences, weather, etc.

In analyzing the link quality, the system then determines a link quality threshold that must be met in order to begin transmission of data (block 504). In one embodiment, the error bound on this measurement is about +/−1 dB. In addition, the system designates an initial data rate and timing to begin transmission (block 504). The system will continue to monitor the link quality (SNR in one embodiment) until the threshold is met (block 506). Once the system determines that the threshold is met (decision block 508), the system will begin data transmission at the initial rate. In one embodiment, the receiving station will issue the initial rate commands to the satellite, and then the satellite will begin the data download (block 510). In alternative embodiment, the satellite will perform the link analysis functions, and thus, the satellite will begin transmission when the threshold is met.

During data transmission, the system will monitor the downlink quality (e.g., the SNR of the link) (block 512). In one embodiment, the system will check to determine if the link quality has improved enough to increase the data transmission rate (decision block 514). If the transmission can support a higher rate, the system will increase the data rate (block 518). If the link quality has diminished (e.g., the satellite is moving further away from the receiving station) (decision block 516), the system will decrease the data transmission rate (block 520).

After the data transmission rate has been changed, the system will continue the data download (block 522). If the download is finished (decision block 524), the download stops (block 526). Otherwise, the system will continue to monitor the link quality and status, change the data rate as appropriate, and continue the download (blocks 512-522).

The maximum allowed data rate at any time during the satellite pass in constrained to the maximum data rate (curve 306 in FIG. 3) decremented by some uncertainty in the SNR estimation and a designated SNR margin. In one embodiment, the data rate is continuously varied during the satellite pass. This embodiment provides the best channel match, and thus, the largest possible download rate. The implementation complexity for this embodiment, however, is more complex.

In another embodiment, the data rate is incremented and decremented by integer multiples of a base rate. For example, if the base or initial rate is 155 Mbps (OC-3), the data rate increments can be integer multiples of that rate (i.e., 310 Mbps, 465 Mbps, 620 Mbps, and so on). In yet another embodiment of the invention the data rate is incremented and decremented by factors of 2. For example, if the base or initial rate is 155 Mbps (OC-3), the data rate increments will be factors of 2 of that rate (i.e., 310 Mbps (OC-6), 620 Mbps (OC-12), 1.24 Gbps (OC-24), 2.28 Gbps (OC-48), etc.). With these latter two embodiments, the total data download per pass is not quite as high as the first, but the implementation complexity is easier.

In one embodiment, the data rate is switched in response to the measure of SNR of the link signal. The switching decision is a result of an average SNR measured over a time interval. In one embodiment, the time interval can be tens of seconds to several minutes to avoid short term variability and unnecessary switching (this applies to the second 2 embodiments only).

The data rate may vary over a considerable range during a satellite pass. At the lower elevations of the satellite, for example, the link only will accommodate relatively low data rates, but at the higher elevations, much higher data rates can be supported. As one skilled in the art will appreciate, however, each satellite is allocated only a limited bandwidth within which it must downlink its data. This bandwidth determines the symbol rate. The data rate is varied by changing the signal complexity (order of QAM).

For example, at lower elevations of the satellite, the link only will allow relatively low data rates, so a quaternary phase shift keying QPSK symbol spectrum can be used without occupying the entire allocated bandwidth. At these lower elevations, one can increase the data rate by increasing the QPSK symbol rate, because the satellite's allocated bandwidth has not been fully utilized. When the data throughput rate reaches about 1.5 times the passband, other symbol configurations need to be used. That is, because of the bandwidth limitations, one cannot simply increase the symbol rate to increase the data rate; the waveform complexity should be changed so that each symbol represents more bits. For example QPSK symbols will represent 2 bits and 8PSK symbols will represent 3 bits. Similarly, 16 quadrature amplitude modulation (QAM) symbols will represent 4 bits, 32 QAM will represent 5 bits, 64 QAM will represent 6 bits, 128 QAM will represent 7 bits, 256 QAM will represent 8 bits, and so on. Thus, once the maximum symbol rate has been reached due to bandwidth limitation, the data rate can only be increased by increasing the symbol complexity.

To accomplish this, the satellite comprises a transmitter that can dynamically adapt its QAM complexity. As discussed above, one embodiment of a transmitter that can be used is a the Modulating Array Transmitter (MAX) disclosed in U.S. Pat. No. 5,612,651, the entirety of which is incorporated herein by reference for all purposes. Similarly, an adaptive rate receiver is used.

Figure 6:
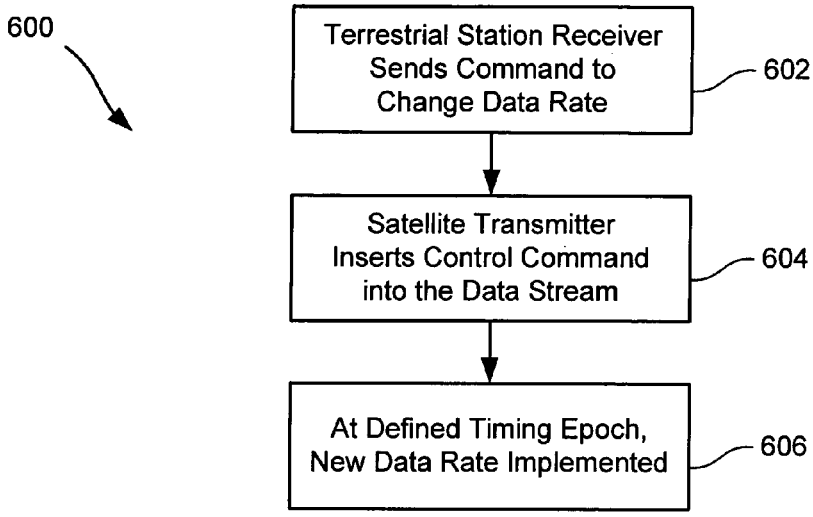
FIG. 6 is a flow chart illustrating one embodiment of a method for changing the data rate transmission in an adaptive data rate transmission system.

Referring now to FIG. 6, flow chart 600 illustrates one embodiment of a method synchronizing the data rate change. In the illustrated embodiment, the terrestrial receiving station monitors the link quality, and when it determines that the quality is good enough to support a higher rate, it sends a command from the receiving station to the satellite, instructing the satellite to change the data rate (block 602). In one embodiment the command sent from the receiving station to the satellite includes information indicating the new rate to be changed to. In another embodiment of the invention, the command is merely a command to change the rate; the new rate is preprogrammed and known by both the transmitter on the satellite and the receiver at the receiving station.

When the satellite receives the command to change, the satellite (and in one embodiment, the adaptive rate transmitter in the satellite) inserts a control word into the data stream, defining a timing epoch upon which the data rate change is to take place (block 604). At the defined timing epoch, the rate adaptive transmitter sends, and the rate adaptive receiver receives the data transmission at the new rate (block 606). In this embodiment, the receiver is primed for the rate change, because it made the decision to change the rate. Thus, the receiver can preload the rate change mechanism with the new data rate and need only await the control message from the satellite transmitter.

As stated above, the satellite transmitter sends a control command to the receiver in the data stream to effect the rate change. This control command or message can be embedded in the transmission in one of several ways. The rate change control command itself is constructed so that the receiver may correctly identify it unambiguously in the presence of the data message. In one embodiment, the control command or message may be imbedded in the data traffic as "substituted bits" that create payload data bit errors. In this embodiment, the bit error substitution may be corrected by forward error correction (FEC) decoding in the receiver. In an alternative embodiment, time division multiplexing may be used to insert the control bits.

Figure 7:
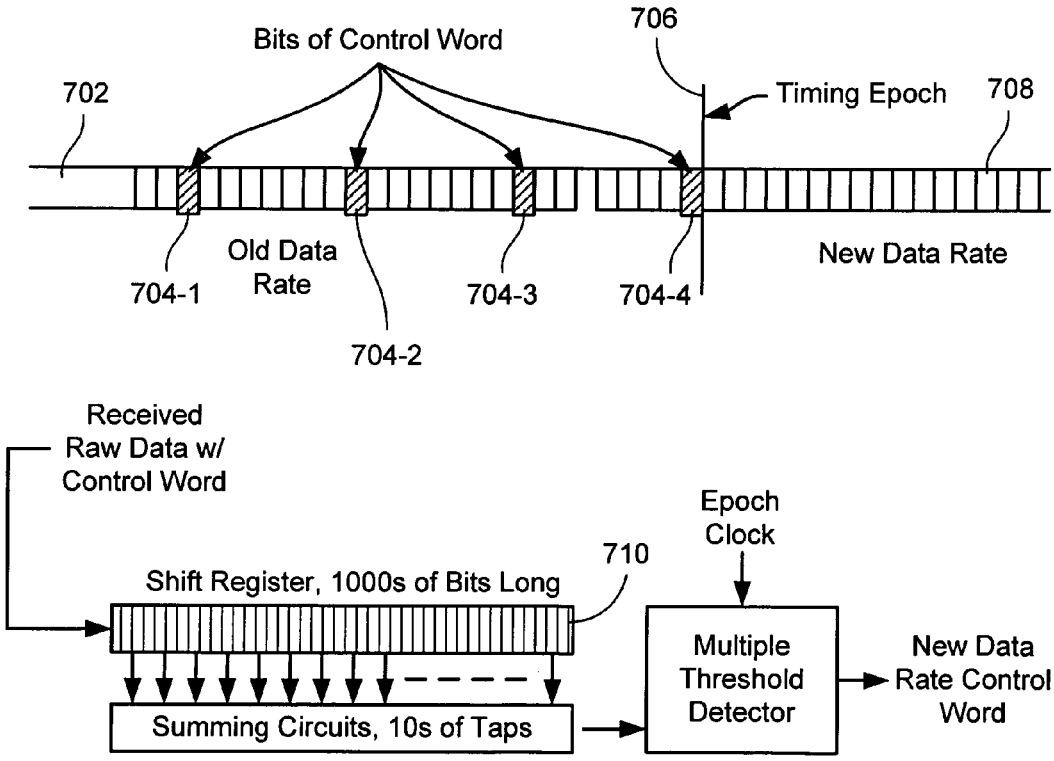
FIG. 7 is a block diagram showing one method for encoding and decoding data rate control commands in a data stream.

Referring now to FIG. 7, the encoding and decoding of the control command bits into and out of the data stream will be described. As illustrated in FIG. 7, data stream 702 will include control word bit 704, which define the timing epoch 706. At the timing epoch, the transmitter and receiver will send and receive the new data stream 708 at the new rate.

In one embodiment, the control message from the satellite transmitter may comprise short shift register sequences which have known desirable correlation properties. In this embodiment, the control commands are long enough so that the likelihood of the command occurring in a sequence of random data is extremely small, and short enough to enable the construction of a practical length receive matched filter that will yield low false alarm probabilities and low false dismissal probabilities. For example, with this embodiment, the data stream enters shift registers 710 in the receiving station. From shift registers 710 the data bits are summed in a summing circuit and decoded in a matched filter. After the last bit of the control word enters the matched filter, the next receive symbol is at the new data rate.

In conclusion, the present invention provides novel systems and methods for implementing an adaptive data rate transmission for downloading data from a satellite to a terrestrial receiving station. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A method for transmitting data from a satellite to a terrestrial receiving station, comprising:

estimating a link quality between the satellite and the terrestrial receiving station;

setting an initial transmission rate based on the link quality estimate;

establishing a data transmission at the initial transmission rate from the satellite to the terrestrial receiving station;

monitoring one or more downlink parameters of the data transmission;

when the one or more downlink parameters meet a criteria, adjusting the data transmission to a new data transmission rate; and transmitting the data at the new data transmission rate.

2. The method as recited in claim 1, wherein the step of estimating a link quality comprises estimating a signal to noise ratio for the communication between the satellite and the terrestrial receiving station, and wherein the step of setting the initial transmission rate comprises setting the initial transmission rate based on the estimated signal to noise ratio.

3. The method as recited in claim 1, wherein the step of establishing a data transmission, further comprises:

determining a minimum threshold signal quality for the data transmission;

monitoring a signal quality of the communication between the satellite and the terrestrial receiving station; and upon reaching the minimum threshold signal quality, establishing the data transmission at the initial transmission rate.

4. The method as recited in claim 3, wherein the signal quality is a signal to noise ratio.

5. The method as recited in claim 1, wherein the step of monitoring one or more downlink parameters comprises monitoring one or more parameters selected from the group consisting of signal to noise ratio, data error rate, and location of the satellite in relation to the terrestrial receiving station.

6. The method as recited in claim 1, wherein the criteria include positive and negative signal quality criteria, and wherein the step of adjusting the data transmission comprises adjusting the data transmission to a higher data transmission rate when the one or more downlink parameters meet positive signal quality criteria, and adjusting the data transmission to a lower data transmission rate when the one or more downlink parameters meet negative signal quality criteria.

7. The method as recited in claim 1, wherein the step of adjusting the data transmission comprises adjusting the data transmission to a new data transmission rate that is determined from the one or more downlink parameters.

8. The method as recited in claim 1, wherein the step of adjusting the data transmission comprises adjusting the data transmission to a new data transmission rate that is an integral multiple of the initial data transmission rate.

9. The method as recited in claim 1, wherein the step of adjusting the data transmission comprises adjusting the data transmission to a new data transmission rate that is a factor of two of the initial data transmission rate.

10. The method as recited in claim 1, wherein the monitoring step is performed by the terrestrial receiving station, and wherein the step of adjusting the data transmission comprises:

sending a command from the terrestrial receiving station to the satellite, the command instructing the satellite to change the data transmission rate;

inserting control data into the data stream transmission, the control data defining a timing epoch upon which the new data transmission rate is to be implemented; and upon reaching the timing epoch, the satellite sending and the terrestrial receiving station receiving data at the new data transmission rate.

11. The method as recited in claim 1, wherein the step of adjusting the data transmission comprises:

inserting control data into the data transmission, the control data defining a timing epoch upon which the new data transmission rate is to be implemented; and upon reaching the timing epoch, the satellite sending and the terrestrial receiving station receiving data at the new data transmission rate.

12. The method as recited in claim 1, wherein the data is transmitted in symbols, and wherein the step of adjusting the data transmission comprises changing the symbol complexity of the data transmission.

13. The method as recited in claim 12, wherein the symbols may comprise symbols selected from the group consisting of binary phase shift keying (BPSK) symbols, quaternary phase shift keying (QPSK) symbols, 8PSK symbols, or quadrature amplitude modulation (QAM) symbols.

14. A system for transmitting data from a satellite to a terrestrial receiving station, comprising:

a satellite including rate adaptive data transmitter; and a terrestrial receiving station including a rate adaptive data receiver;

wherein the system is configured to:

estimate a link quality between the rate adaptive data transmitter and the rate adaptive data receiver;

set an initial transmission rate based on the link quality estimate;

establish a data transmission at the initial transmission rate from the rate adaptive data transmitter associated with the satellite to the rate adaptive data receiver associated with the terrestrial receiving station;

monitor one or more downlink parameters of the data transmission;

when the one or more downlink parameters meet a criteria, both the rate adaptive data transmitter and the rate adaptive data receiver adjust the data transmission to a new data transmission rate; and transmit the data from the rate adaptive data transmitter to the rate adaptive data receiver at the new data transmission rate.

15. The system as recited in claim 14, wherein the system estimates the link quality by estimating a signal to noise ratio for the communication between the rate adaptive data transmitter and the rate adaptive data receiver, and wherein the system sets the initial transmission rate based on the estimated signal to noise ratio.

16. The system as recited in claim 14, wherein the system is further configured to:

determine a minimum threshold signal quality for the data transmission;

monitor a signal quality of the communication between the rate adaptive data transmitter and the rate adaptive data receiver; and upon reaching the minimum threshold signal quality, establish the data transmission at the initial transmission rate.

17. The system as recited in claim 16, wherein the signal quality is a signal to noise ratio.

18. The system as recited in claim 14, wherein the one or more downlink parameters comprises parameters selected from the group consisting of signal to noise ratio, data error rate, and location of the satellite in relation to the terrestrial receiving station.

19. The system as recited in claim 14, wherein the criteria include positive and negative signal quality criteria, and wherein the system adjusts the data transmission to a higher data transmission rate when the one or more downlink parameters meet positive signal quality criteria, and the system adjusts the data transmission to a lower data transmission rate when the one or more downlink parameters meet negative signal quality criteria.

20. The system as recited in claim 14, wherein the system adjusts the data transmission to a new data transmission rate that is determined from the one or more downlink parameters.

21. The system as recited in claim 14, wherein the system adjusts the data transmission to a new data transmission rate that is an integral multiple of the initial data transmission rate.

22. The system as recited in claim 14, wherein the system adjusts the data transmission to a new data transmission rate that is a factor of two of the initial data transmission rate.

23. The system as recited in claim 14, wherein the satellite further comprise a data receiver, and the terrestrial receiving station further comprises a data transmitter, and wherein the terrestrial receiving station monitors the one or more downlink parameters and initiates the adjustment of the data transmission rate.

24. The system as recited in claim 23, wherein rate adaptive data transmitter is configured to format the data transmission prior to transmitting it, and wherein the system adjusts the data transmission rate by:

the data transmitter of the terrestrial receiving station sending a command to the data receiver of the satellite, the command instructing the rate adaptive data transmitter of the satellite to change the data transmission rate;

the rate adaptive data transmitter inserting control data into the data transmission, the control data defining a timing epoch upon which the new data transmission rate is to be implemented; and upon reaching the timing epoch, the rate adaptive data transmitter sending and the rate adaptive data receiver receiving data at the new data transmission rate.

25. The system as recited in claim 14, wherein the satellite monitors the one or more downlink parameters and initiates the adjustment of the data transmission rate.

26. The system as recited in claim 25, wherein rate adaptive data transmitter is configured to format the data transmission prior to transmitting it, and wherein the system adjusts the data transmission rate by:

the rate adaptive data transmitter inserting control data into the data transmission, the control data defining a timing epoch upon which the new data transmission rate is to be implemented; and upon reaching the timing epoch, the rate adaptive data transmitter sending and the rate adaptive data receiver receiving data at the new data transmission rate.

27. The system as recited in claim 14, wherein the data is transmitted in symbols, and wherein the system adjusts the data transmission rate by changing a symbol complexity of the data transmission.

28. The system as recited in claim 27, wherein the symbols may comprise symbols selected from the group consisting of binary phase shift keying (BPSK) symbols, quaternary phase shift keying (QPSK) symbols, 8PSK symbols, or quadrature amplitude modulation (QAM) symbols.

29. A satellite in a satellite communication system configured to transmit data from a satellite to a terrestrial receiving station, the satellite comprising:

a rate adaptive data transmitter;

wherein the rate adaptive data transmitter is configured to:

estimate a link quality between the rate adaptive data transmitter and a rate adaptive data receiver associated with a terrestrial receiving station;

set an initial data transmission rate based on the link quality estimate;

establish a data transmission at the initial data transmission rate with the rate adaptive data receiver; and upon receiving a command from the terrestrial receiving station to change the data transmission rate, transmit the data from the rate adaptive data transmitter to the rate adaptive data receiver at a new data transmission rate.

30. The satellite as recited in claim 29, wherein rate adaptive data transmitter is configured to format the data transmission prior to transmitting it, and the rate adaptive data transmitter transmits the data at the new data rate by:

first inserting control data into the data transmission, the control data defining a timing epoch upon which the new data transmission rate is to be implemented;

transmitting the data transmission including the control data to the rate adaptive data receiver; and upon reaching the timing epoch, the rate adaptive data transmitter sending and the rate adaptive data receiver receiving data at the new data transmission rate.

31. The satellite as recited in claim 29, wherein the data is transmitted in symbols, and wherein the rate adaptive data transmitter adjusts the data transmission rate by changing a symbol complexity of the data transmission.

32. The satellite as recited in claim 31, wherein the symbols may comprise symbols selected from the group consisting of binary phase shift keying (BPSK) symbols, quaternary phase shift keying (QPSK) symbols, 8PSK symbols, or quadrature amplitude modulation (QAM) symbols.

33. A satellite in a satellite communication system configured to transmit data from a satellite to a terrestrial receiving station, the satellite comprising:

a rate adaptive data transmitter;

wherein the rate adaptive data transmitter is configured to:

estimate a link quality between the rate adaptive data transmitter and a rate adaptive data receiver associated with a terrestrial receiving station;

set an initial data transmission rate based on the link quality estimate;

establish a data transmission at the initial data transmission rate with the rate adaptive data receiver;

monitor one or more downlink parameters of the data transmission;

when the one or more downlink parameters meet a criteria, transmit the data from the rate adaptive data transmitter to the rate adaptive data receiver at a new data transmission rate.

34. The satellite as recited in claim 33, wherein rate adaptive data transmitter is configured to format the data transmission prior to transmitting it, and the rate adaptive data transmitter transmits the data at the new data rate by:

first inserting control data into the data transmission, the control data defining a timing epoch upon which the new data transmission rate is to be implemented;

transmitting the data transmission including the control data to the rate adaptive data receiver; and upon reaching the timing epoch, the rate adaptive data transmitter sending and the rate adaptive data receiver receiving data at the new data transmission rate.

35. The satellite as recited in claim 33, wherein the data is transmitted in symbols, and wherein the rate adaptive data transmitter adjusts the data transmission rate by changing a symbol complexity of the data transmission.

36. The satellite as recited in claim 35, wherein the symbols may comprise symbols selected from the group consisting of binary phase shift keying (BPSK) symbols, quaternary phase shift keying (QPSK) symbols, 8PSK symbols, or quadrature amplitude modulation (QAM) symbols.

37. The system as recited in claim 33, wherein the one or more downlink parameters comprises parameters selected from the group consisting of signal to noise ratio, data error rate, and location of the satellite in relation to the terrestrial receiving station.

38. The system as recited in claim 33, wherein the criteria include positive and negative signal quality criteria, and wherein the rate adaptive data transmitter adjusts the data transmission to a higher data transmission rate when the one or more downlink parameters meet positive signal quality criteria, and the rate adaptive data transmitter adjusts the data transmission to a lower data transmission rate when the one or more downlink parameters meet negative signal quality criteria.

* * * * *

UNITED STATES PATENT AND TRADEMARK OFFICE

CERTIFICATE OF CORRECTION

PATENT NO. : 7,469,124 B1
APPLICATION NO. : 10/412553
DATED : December 23, 2008
INVENTOR(S) : Frank Chethik It is certified that error appears in the above-identified patent and that said Letters Patent is hereby corrected as shown below:

In Column 9, line 33: Remove “stream”

Signed and Sealed this

Thirty-first Day of March, 2009

JOHN DOLL
*Acting Director of the United States Patent and Trademark Office*